US008576088B2

(12) United States Patent
Olofsson et al.

(10) Patent No.: US 8,576,088 B2
(45) Date of Patent: Nov. 5, 2013

(54) SENSOR SYSTEM FOR AN ALARM SECURITY DEVICE

(75) Inventors: Håkan Olofsson, Linköping (SE); Jonas Wallinder, Vreta Kloster (SE); Johan Carlsson, Nacka (SE)

(73) Assignee: Boomslang Instruments AB, Stockholm (SE)

( * ) Notice: Subject to any disclaimer, the term of this patent is extended or adjusted under 35 U.S.C. 154(b) by 293 days.

(21) Appl. No.: 13/184,765

(22) Filed: Jul. 18, 2011

(65) Prior Publication Data

US 2012/0013477 A1 Jan. 19, 2012

Related U.S. Application Data

(60) Provisional application No. 61/365,606, filed on Jul. 19, 2010.

(51) Int. Cl.
*G08B 21/00* (2006.01)

(52) U.S. Cl.
USPC ..... 340/687; 340/573.1; 340/686.1

(58) Field of Classification Search
USPC ..... 340/687, 539.1, 539.11, 539.15, 573.1, 340/573.4, 686.1
See application file for complete search history.

(56) References Cited

U.S. PATENT DOCUMENTS

| | | | | |
|---|---|---|---|---|
| 4,300,129 | A | 11/1981 | Cataldo | |
| 4,694,284 | A | 9/1987 | Leveille et al. | |
| 5,438,315 | A | 8/1995 | Nix | |
| 5,521,582 | A * | 5/1996 | Kingston | 340/539.11 |
| 6,278,370 | B1 * | 8/2001 | Underwood | 340/573.1 |
| 7,933,579 | B2 * | 4/2011 | Jenkins | 455/404.1 |

FOREIGN PATENT DOCUMENTS

| | | |
|---|---|---|
| CN | 201278883 | 7/2009 |
| GB | 2285878 | 7/1995 |

* cited by examiner

*Primary Examiner* — Toan N Pham
(74) *Attorney, Agent, or Firm* — Drinker Biddle & Reath LLP

(57) ABSTRACT

The invention provides a new personal security alarm system which has a reliable, non sensitive actuation mechanism. The alarm security device according to the invention comprises an activation clasp which comprises an electronic contact characterized in that said clasp comprises a male part and a receiving female part; and that the male part comprises at least one long contact pin and at least one short contact pin and the female part comprises receiving contact sockets for each of the contact pins, and wherein the electronic contact is settable between three different modes.

13 Claims, 16 Drawing Sheets

SENSOR SYSTEM FOR AN ALARM SECURITY DEVICE

RELATED APPLICATION DATA

This application claims priority under 35 U.S.C. §119(e) to U.S. Provisional Application No. 61/365,606, filed Jul. 19, 2010, the entire contents of which are incorporated herein by reference.

FIELD OF THE INVENTION

This invention relates in general to the field of portable alarm security devices. More particularly the present invention relates to a locking and actuator unit for such a device.

BACKGROUND

General Background

Assaults and criminal activities are increasing. There is a need for people to be able to feel safe and for people who is under threat to still be able to feel free and live normal lives. For example people who live in neighborhoods subject to criminal activity or people that have to pass through hazardous areas, may live with unwanted limitations in their daily life due to their surroundings.

There are security alarm systems developed for such situations in the form of alarm security devices which can be activated by the victim. The alarm security device sends alarm signals upon activation in order to either inform other people, for example by GSM signal, or to inform and alert the attacker by a sound signal.

Specific Background

A person with a need for an alarm security device shall be able to wear the alarm security device without feeling hindered because of its size. Therefore there is a need for a small alarm security device that is easy to wear. There is a need for a secure reliable alarm system device which is easy to produce and is intended for use in a modern environment. The alarm security device should be equipped with modern, robust electronics in the smallest format which makes the alarm security device reliable and trustworthy to avoid false security. There is also a need of an alarm security device that can withstands rough handling, also when used by an active child. In other words, the alarm security device should be suitable for non careful users. Further there is a need for an alarm bracelet to be water resistant. In the case of a kidnapping situation, the alarm security device should not be easily removed from the wearer.

PRIOR ART

There is prior art which shows security alarm systems wherein the alarm is activated by pressing an alarm button. See for example U.S. Pat. No. 5,438,315 which shows an alarm with a transmitting unit adapted to be worn as a bracelet equipped with a push button to activate the alarm signal.

Patent document, U.S. Pat. No. 4,300,129, shows a signaling device belt intended for policemen. The wearer of the belt can activate a radio transmitter by a pull force on the buckle on the belt. When the belt is pulled out, a switch is engaged which activates the transmitter. The wearer is informed if he is near to activate a signal (the activation is in several steps) to avoid false transmitter signals.

Examples of other prior art documents regarding alarm systems include U.S. Pat. No. 4,694,284, GB 2 285 878 A, CN 201278883 Y.

OBJECT OF THE INVENTION

One object of the invention is to provide a new and improved security alarm system. A more specific object is to provide a new and improved actuation mechanism which is reliable and non-sensitive. Situations wherein a person wants to activate the alarm signal are often stressful and not easily predicted, therefore there is a need for an activation mechanism which is easy activatable, reliable and that provides essential information after activation so that the bearer of the alarm security device feels safe.

SUMMARY OF THE INVENTION

There is a need of improved alarm security devices so that people can feel safe and live normal lives. This invention regards a sensor system for an alarm security device.

In a first aspect the inventive concept regards an alarm security device comprising an activation clasp which comprises an electronic contact 20 characterized in that said clasp comprises a male part and a receiving female part; and that the male part comprises at least one long contact pin and at least one short contact pin and the female part comprises receiving contact sockets for each of the contact pins and wherein the electronic contact is settable between three different modes;

- A detached mode where none of the contact pins of the male part are in connection with the contact sockets of the female part of the clasp and thus the electronic contact and the clasp is open; and
- A normal mode wherein all the contact pins of the male part are in connection with the contact sockets of the female part, and the clasp is closed; and
- An elongated mode wherein the short contact pin of the male part lacks connection with the contact socket of the female part while the long contact pin of the female part is/are connected to the contact socket of the male part and when entering the elongated mode an alarm signal is sent.

In an embodiment of the invention the alarm security device is in the form of a bracelet, wristband or necklace, configured to be worn around a body part of a user.

Further varieties of the inventive concept regarding such an alarm security device are any of the following optional individual or combinable aspects:

An alarm security device according arranged to be transformed between said modes of the clasp into elongated mode is performed by a pull mechanism whereby a traction force separates the male and the female part of the clasp.

An alarm security device wherein said alarm signal is a digital signal.

An alarm security device according wherein said alarm signal is a audio signal.

An alarm security device according wherein when entering the elongated mode an alarm signal is sent to a central server.

An alarm security device when entering the normal mode from the detached mode the electronics in the alarm security device is activated.

An alarm security device when entering the normal mode from the elongated mode by using a deactivation code, the alarm signal in the alarm security device is not triggered.

An alarm security device when entering the detached mode from the normal mode without entering a deactivation code, an alarm signal is triggered.

An alarm security device comprising chargeable batteries and wherein one side of the electronic contact, is configured to receive a battery charger.

An alarm security device wherein the three different modes is supported by a mechanic clasp mechanism.

An alarm security device comprising GPS or GPRS or Wi-Fi modules and is active by automatically determining the position of the alarm security device by GPS or GPRS or Wi-Fi at a predetermined frequency in normal mode and wherein the frequency is further increasing when entering elongated mode.

An alarm security wherein the alarm signal type sent to the central server is dependent on whether if the signal is triggered entering elongated mode or detached mode or not.

BRIEF DESCRIPTION OF THE FIGURES

The present invention will be further explained below with reference to the accompanying drawings, in which.

3*b* an exemplifying embodiment of the configuration of the electronic contact in non normal mode showing the location of the contact pins and contact sockets of the alarm security device according to the present invention.

FIG. 4 shows an exemplifying embodiment of a clasp of the alarm security device, according to the present invention containing the electronic contact with the contact pins of the alarm security device in normal mode from a top-view and side view, showing the first protrusion inside the transversal leg of the L-shaped recess.

Figure 5A:
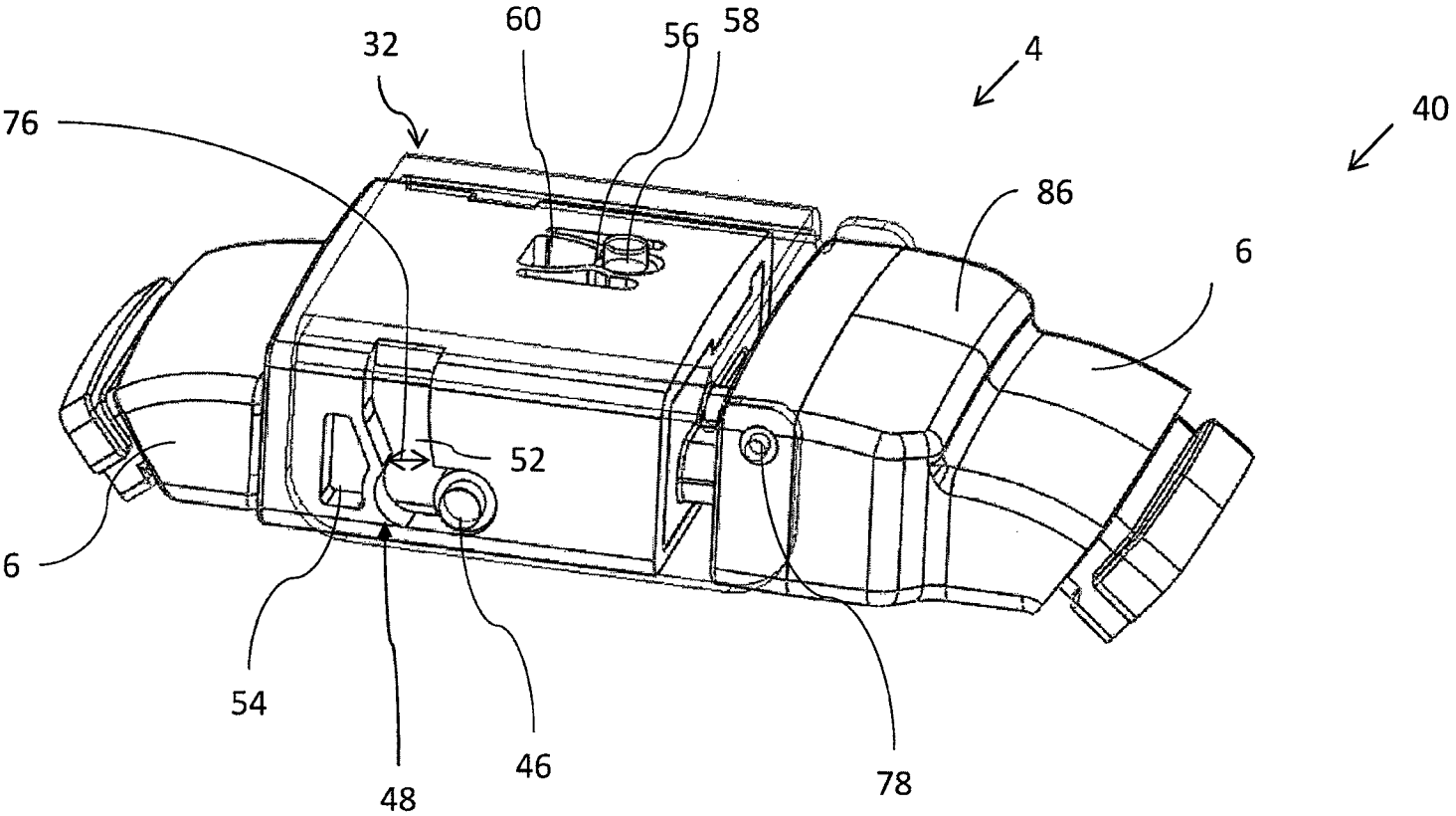

FIG. 5*a* shows an exemplifying embodiment of a clasp of the alarm security device, according to the present invention of the alarm security device in elongated mode, showing the first protrusion inside the longitudinal leg of the L-shaped recess.

Figure 5B:
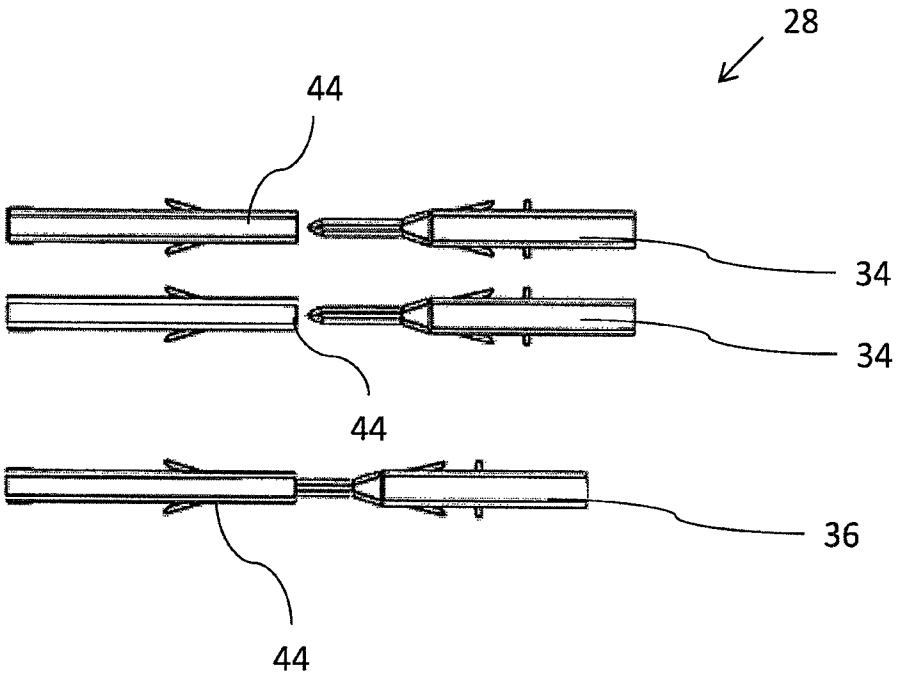

FIG. 5*b* shows an exemplifying embodiment of the electronic contact of the present invention showing the location of the contact pins and contact sockets of the alarm security device when the clasp is in elongated mode.

Figure 6A:
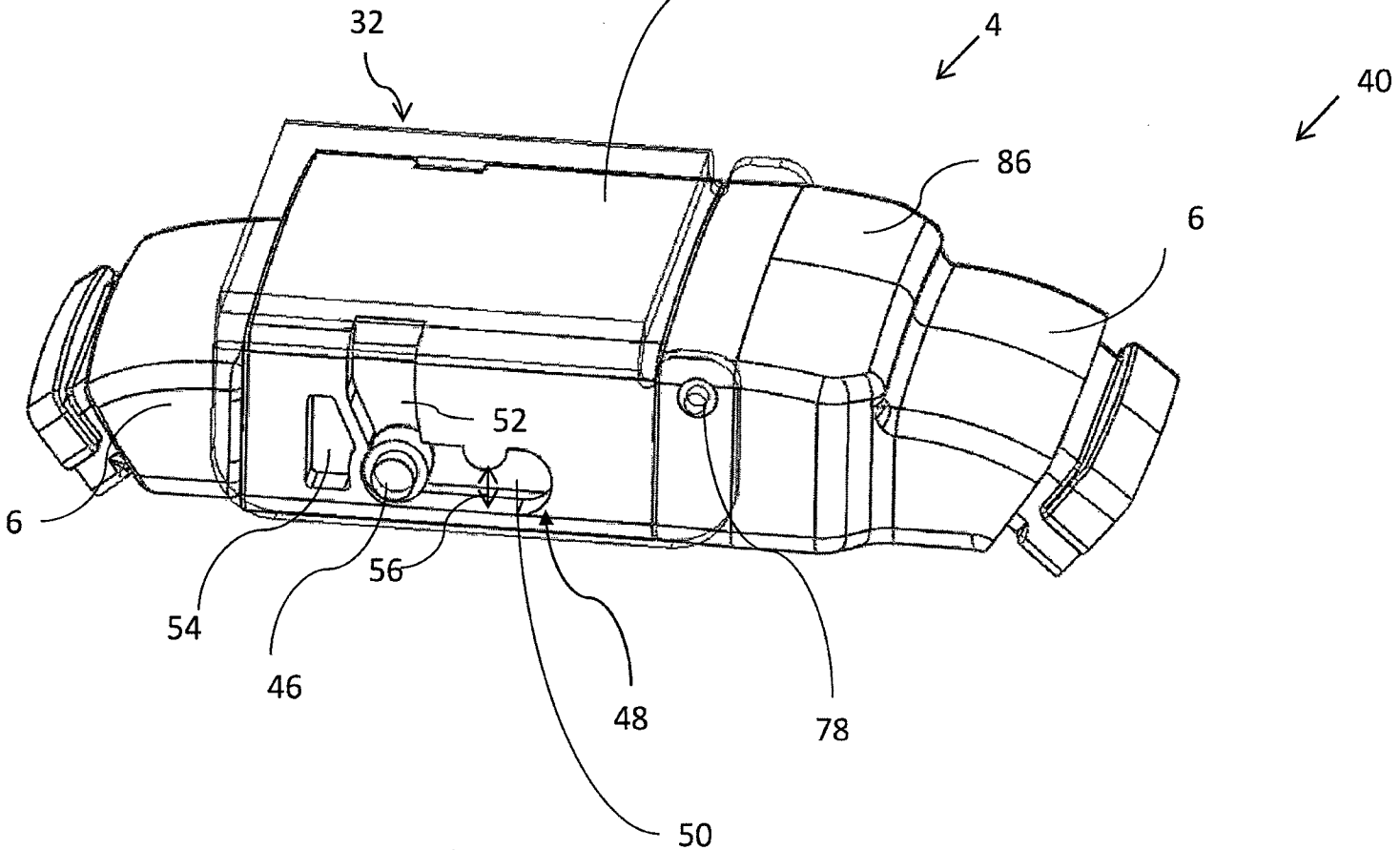
Figure 6B:
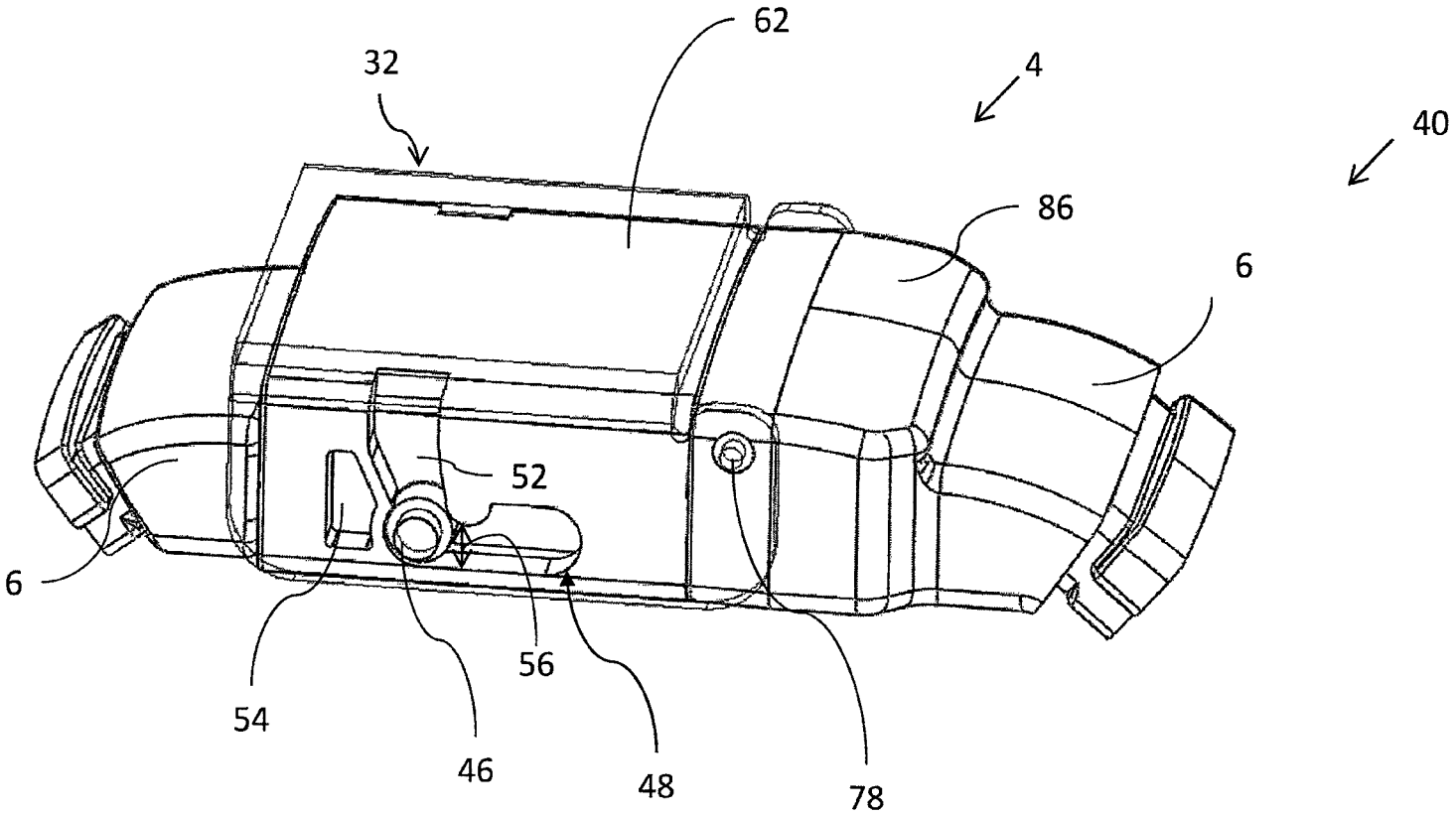

FIG. 6*a-b* shows exemplifying embodiments of alternative solutions for mechanical details of a clasp of the alarm security device, according to the present invention.

Figure 7:
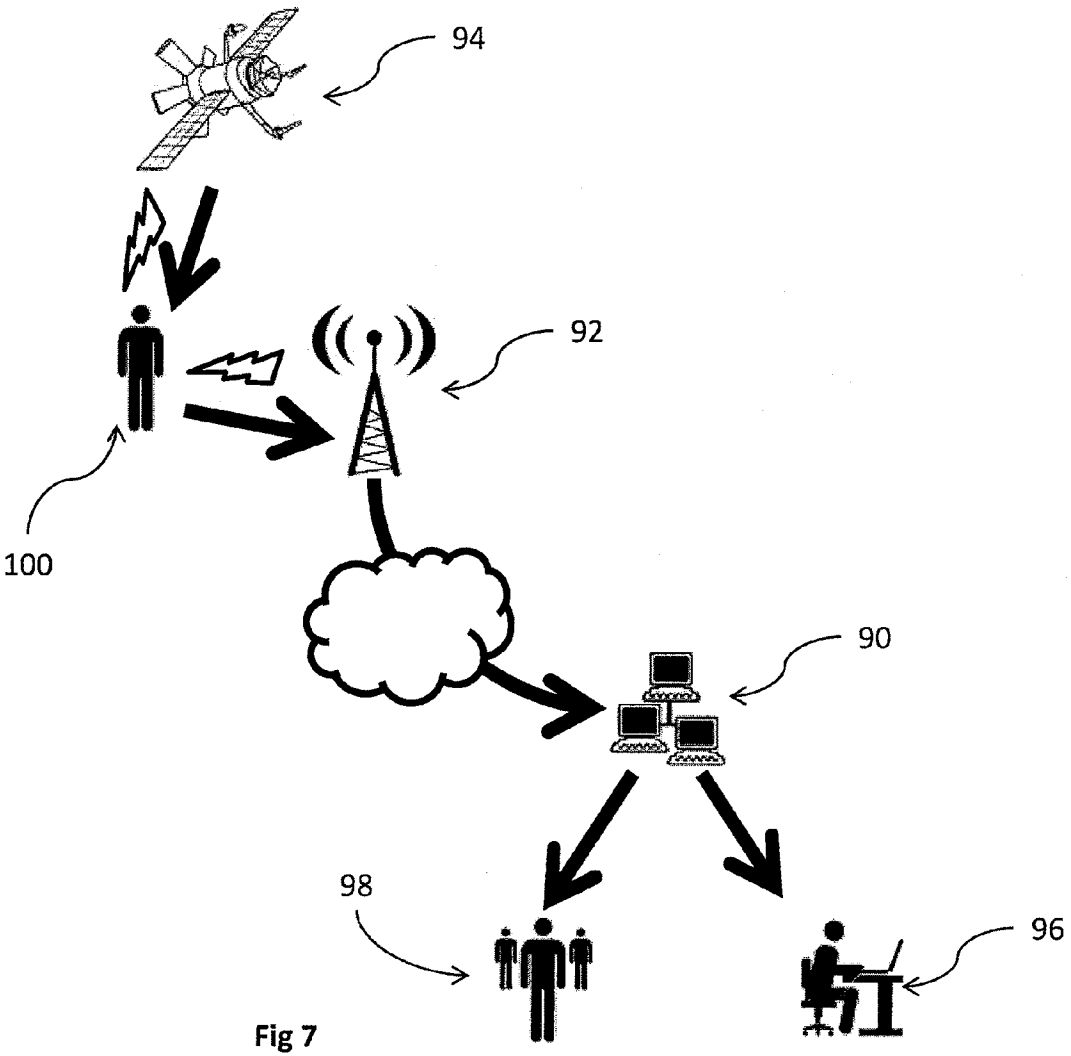

FIG. 7 shows an example of a brief description of how the signaling system of the clasp may work.

Figure 8:
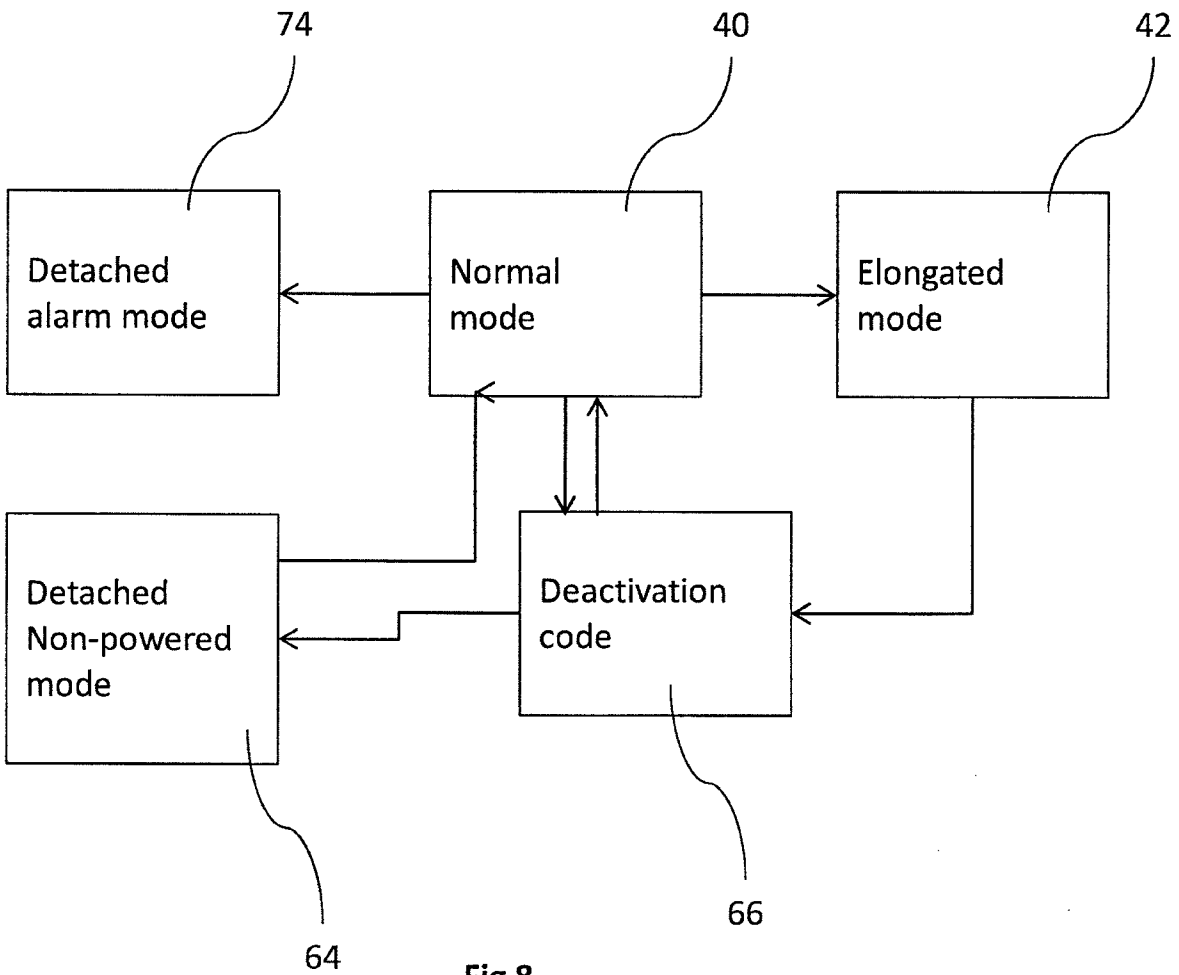

FIG. 8 shows a schematic view of exemplifying transitions of the different modes of the clasp.

Figure 9:
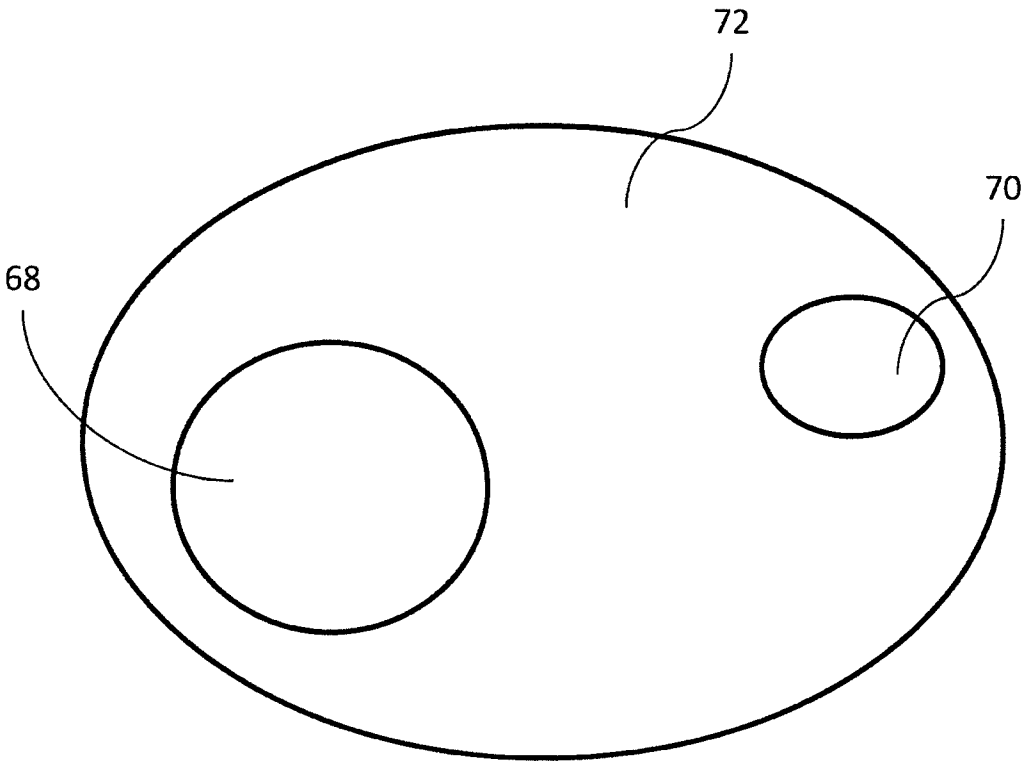

FIG. 9 shows an example of how the frequency of automatic positioning determination usage of the clasp in the normal mode changes when changing geographic zone.

DETAILED DESCRIPTION OF THE INVENTION

Introduction

The invention provides a new personal security alarm system which has a reliable, non sensitive actuation mechanism.

In certain situations alarm security device bearer wants to activate the alarm signal. These situations are often stressful, therefore there is a need for an activation mechanism which is easily accessible for the user and also easy to handle but at the same time, not too easy to activate so it is activated by mistake. There is also a need for an alarm security device which is capable of sending alarm signals to a central server and wherein the central server can distinguish between different alarm signals depending on alarm situation.

The alarm security device according to the invention holds all of these capabilities.

General Description of the Alarm Security Device

Figure 1A:
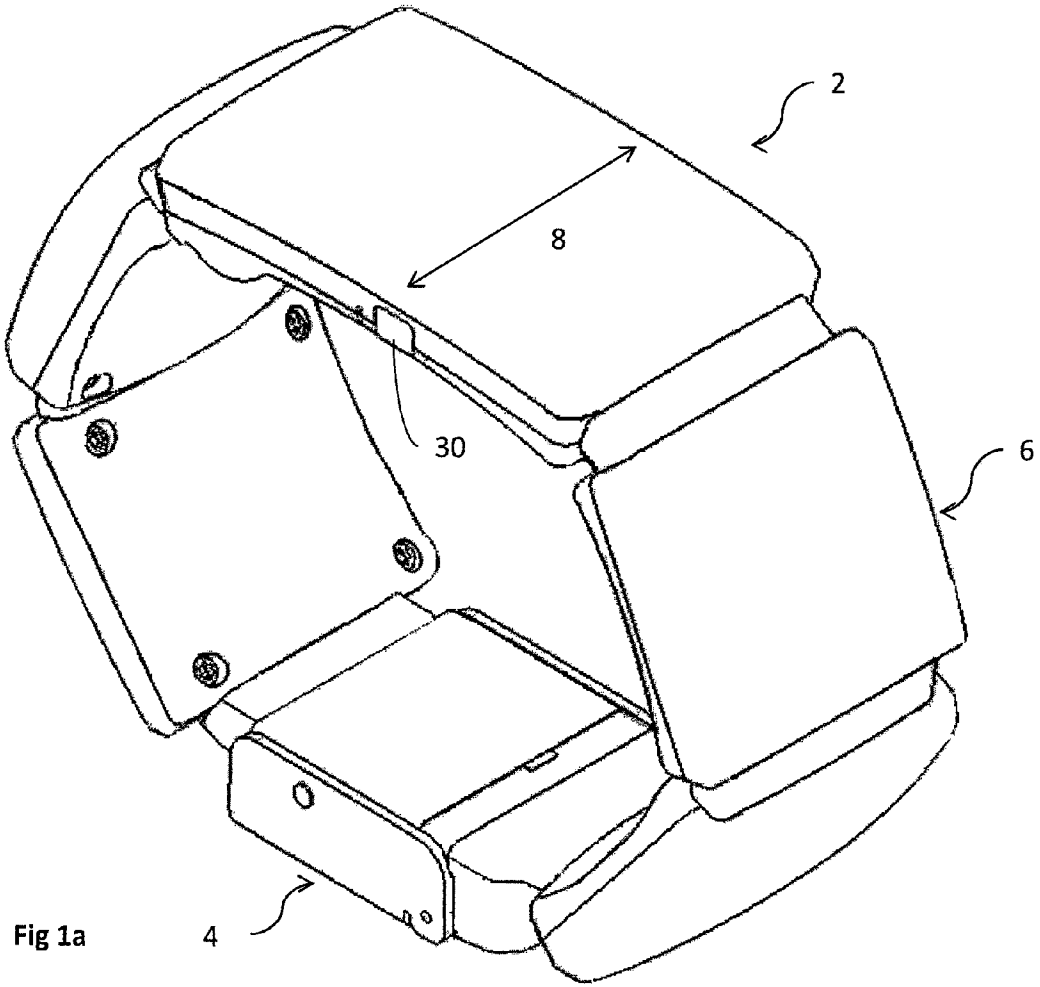
FIG. 1*a-b* shows an exemplifying embodiment of an alarm security device according to the present invention in the form of a bracelet.
Figure 1B:
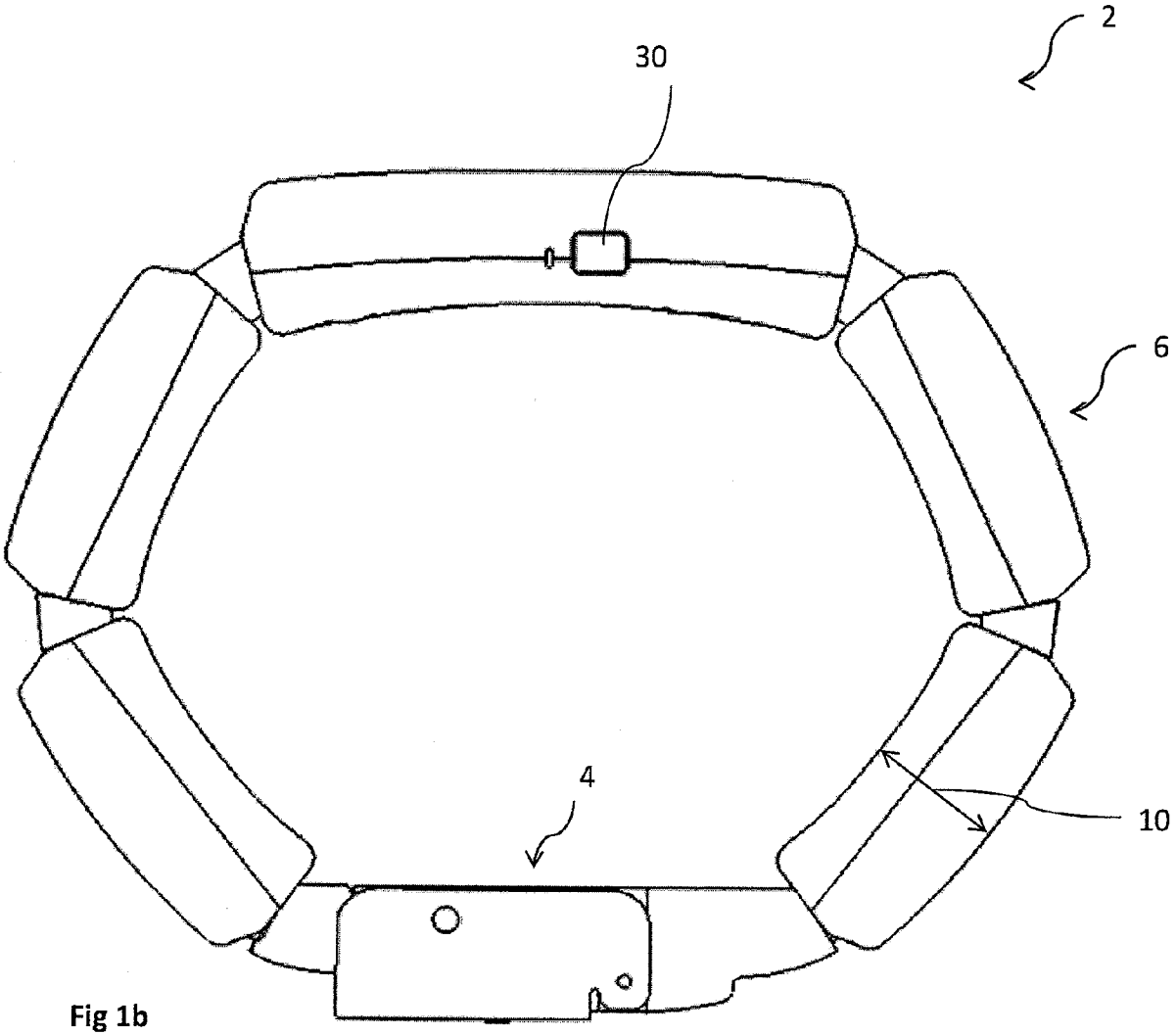

The alarm security device according to the invention is preferably in the form of a bracelet, wristband, necklace, belt or similar device intended to be worn around a body part of a user. FIG. 1*a-b* shows an exemplifying embodiment of the alarm security device 2 of the invention in the form of a bracelet. The bracelet enables the bearer to report its position in real-time and also to launch an alarm to a predefined group of friends or/and to a call center in case of emergency.

The alarm security device 2 is equipped with a clasp 4 and a chain 6 which is intended to fit around a body part of a user. The clasp 4 is equipped with an electronic contact which actuates an alarm when the chain 6 or the clasp 4 of the bracelet is pulled with a certain force so that the male 24 and female parts 22 of a contact inside the clasp of the alarm security device 2 are separated (see below). The alarm signal is also actuated if the alarm security device 2 is removed from the bearer without using a deactivation code 66 (Cf FIG. 8 further explained below).

One type of alarm signal is sent if the alarm is activated by pull-force and another type of alarm signal is sent if the bracelet is opened without using deactivation code 66, or if it is cut open. The alarm signal can be a noise signal or a digital signal.

The alarm security device 2 contains different electronic modules, for example positioning apparatus (GPRS, GPS or Wi-Fi), GSM modules and/or antennas and a SIM card with a SIM card holder, which all is hidden in the chain of the bracelet. The chain also contains chargeable batteries, for example lithium batteries, which supplies the different functions of the device with power. The batteries are preferably connected to the electronic contact of the clasp such that it may be charged by attaching one side of the electronic contact to a power source. In one embodiment of the invention the female part 22 is attached to a power source for charging the batteries of the alarm device 2. The electronic modules are spread inside the chain of the alarm security device. The clasp is also equipped with a code-button 30 (see FIG. 1*a-b*) which can be used for deactivation of the alarm signal, the deactivation code 66 also inactivates the bracelet, to a non-power supplied mode, for example before removal.

The alarm security device 2 according to the invention is preferably covered or disguised with jewelry or other decorations so that the technical functions of the bracelet are not revealed. The appearance of the alarm security device 2 is for example an exclusive jewelry piece and does not reveal the alarm functions which are hidden inside the cover of the device. In a kidnapping situation, the appearance is of importance because the kidnapper does not feel the need to remove the alarm security device if he isn't aware of its functions. Thereby the alarm security device stays on the bearer and the device thus is able to send the victim's position to a central server.

The chain is designed as thin and small as possible. The alarm security device preferably has a chain thickness 10 which is preferably 5-20 mm and a chain width 8 which is preferably 10-30 mm (see FIG. 1). These measures are not limiting, the alarm security device can be configured in any size for wear by a human.

Alarm Security Device in Detached Mode

Sensor System

Figure 2A:
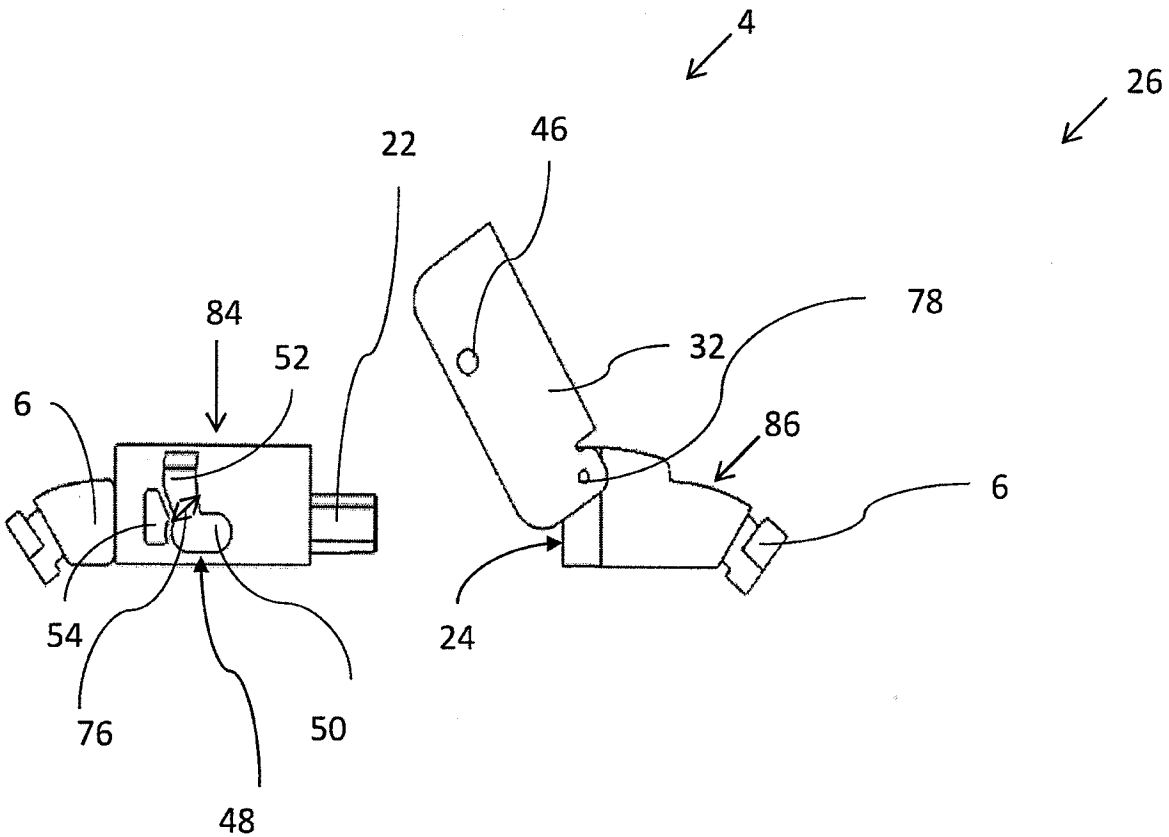
FIG. 2*a-b* shows an exemplifying embodiment of a clasp of an alarm security device containing an electronic contact with female and male parts according to the present invention, separated in a detached mode configuration.
Figure 2B:
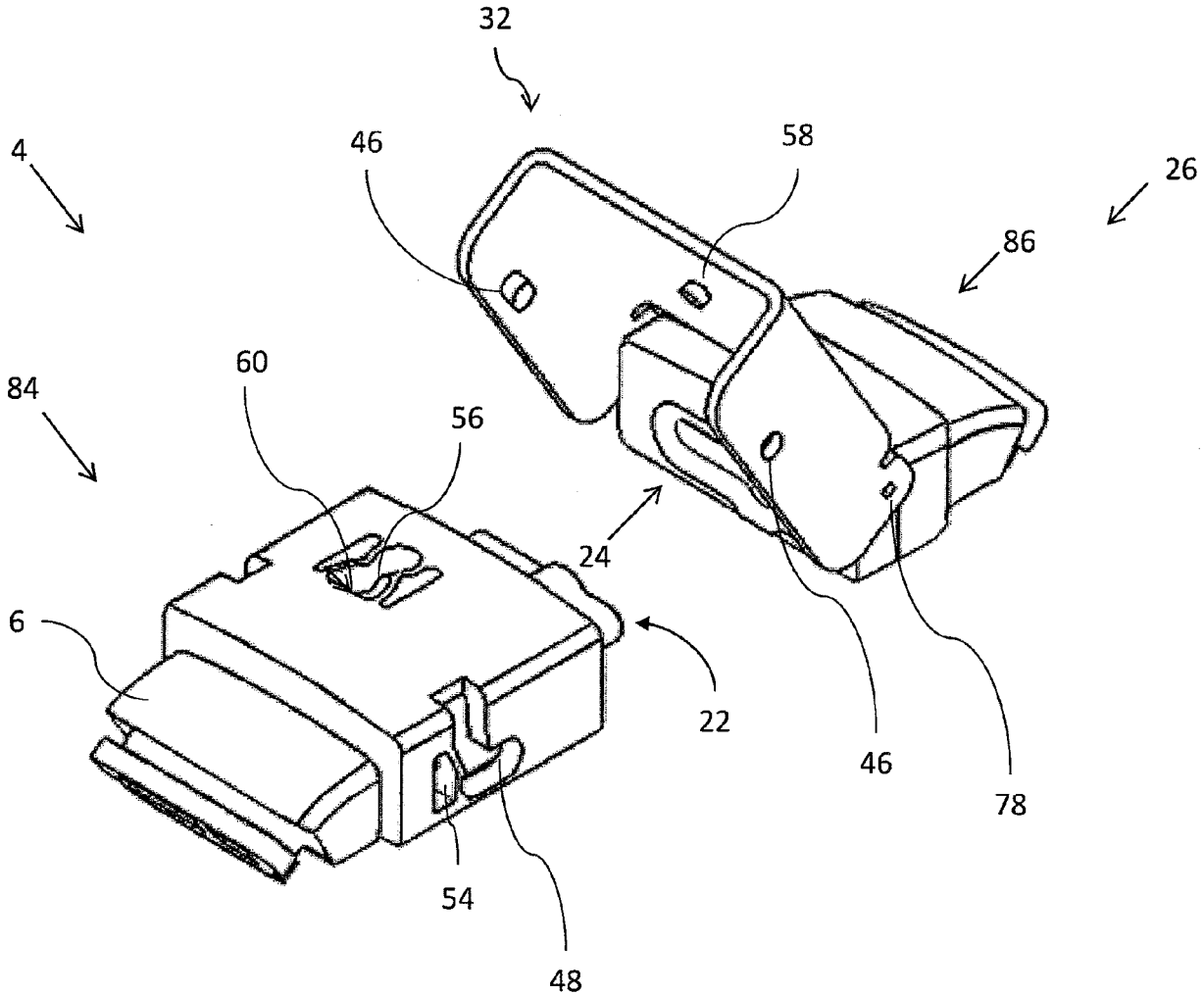

FIGS. 2*a* and 2*b* shows an exemplifying embodiment of a clasp 4 according to the present invention in detached mode 40 (Cf. FIG. 8 further explained below) from two different angles. FIG. 2*a-b* also shows a sensor system of the clasp which senses which in which mode the clasp is configured.

Figure 2C:
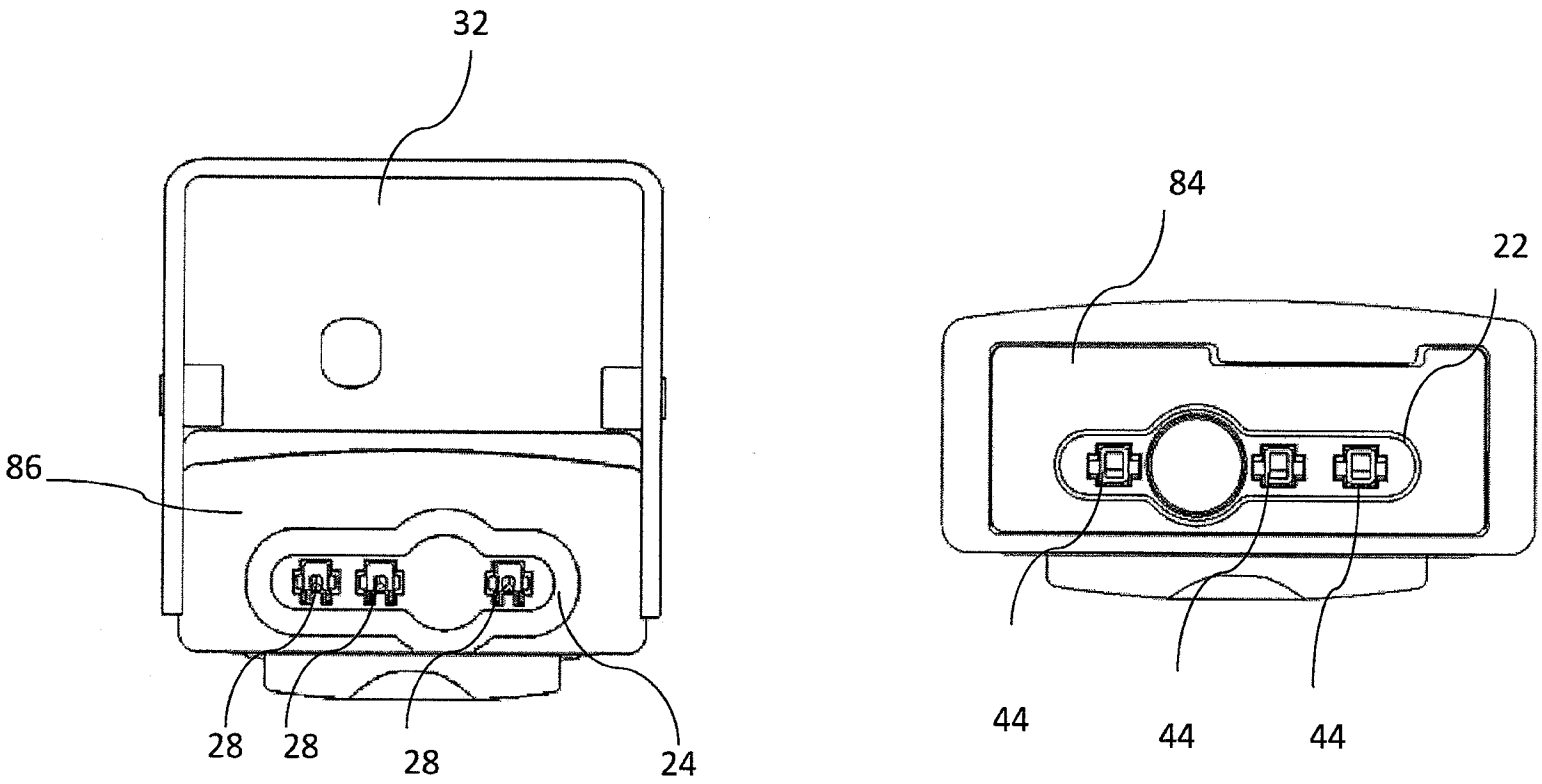
FIG. 2*c* shows an exemplifying embodiment of a clasp of an alarm security device containing an electronic contact with female and male parts according to the present invention separated in a detached mode configuration and showing how the contact pins and contact sockets are located inside the electronic contact of the clasp.

FIG. 2*c* shows that the sensor system comprises contact pins 28 inside the male part 24 located on the lid fastening structure 86 of the electronic contact 20 and contact sockets 44 inside the female part 22 located on the lock mechanism comprising structure 84 of the other part of the electronic contact 20 of the clasp 4.

In the shown example, the male part 24, i.e. the part holding the contact pins 28, is configured as a pocket. The female part 22, i.e. the part housing the contact sockets 44 is in the shown example arranged as a protruding part (see FIG. 2*a-c*). In other embodiments, the male part 24 may be protruding while the female part 22 is arranged as a pocket.

When the clasp 4 is in detached mode 26, the electronic contact 20 is open. None of the contact pins 28 of the male part 24 are in connection with the contact sockets 44 of the female 22 part of the clasp 4 in detached mode 26. The alarm security device 2 can be active/power supplied (in detached alarm mode 74) or non-active (see further below), without power supply (in detached non-powered mode 64) in this configuration.

Clasp Details

FIG. 2*a*-2*b* shows that the clasp 4 comprises a locking mechanism with a lid 32. The clasp 4 comprises a lid fastening structure 86 which is fastened to one side of the chain 6 of the alarm security device 2 and a lock mechanism comprising structure 84 located on the other end of the chain 6. The lid 32 is fastened to the lid fastening structure 86 by a lid pivoting joint 78 which allows the lid to be opened and closed. The lid in FIGS. 2*a* and 2*b* comprises one part of a two part lock mechanism; a first protrusion 46. The lock mechanism comprising structure 84 in the example in FIG. 2*a* and *b* comprises the other part of the two parted lock mechanism, an L-shaped recess 48. In other examples of the invention the lid 32 comprises the L-shaped recess and the lock mechanism comprising structure 84 comprises the first protrusion 46.

In FIG. 2*a* the L-shaped recess is in the form of the capital letter L, in other embodiments the L-shaped recess is a modified L or more V shaped. The L-shaped recess comprises a transversal leg 52 and a longitudinal leg 50. The first protrusion 46 is intended to fit inside the L-shaped recess 48. In the exemplified embodiment in FIG. 2*a*-2*b* the transversal leg 52 comprises an optional lid fastening narrowing 76. Also in one alternative embodiment of the invention, next to the L-shaped recess 48 in FIG. 2*a*, an optional, assisting recess 54 is shown. The assisting recess 54 gives the walls of the transversal leg 52, the fastening narrowing 76, of the L-shaped recess 48 flexibility. In other embodiments of the invention the surface surrounding the narrowing does not contain assisting recesses 54.

Functions

The alarm security device 2 is powered when the clasp is closed (and in normal mode configuration 40), the alarm security device 2 automatically checks for its position in said powered mode. The alarm security device 2 can be removed from the bearer, and thus transformed from normal to detached mode, in two different ways. The first way is via the code-button 30 entering a deactivation code 66 (Cf. FIG. 8 further explained below) prior to opening the clasp, leading to detached non-powered mode 64 (see also activation scheme in FIG. 8). The other way is by taking the alarm security device 2 off without using a deactivation code 66, leading to detached alarm mode 74.

If the bearer uses a deactivation code 66 prior to removal (by opening lid 32 and in the end separating the male 24 and female part 22 of the clasp) of the alarm security device 2, it is deactivated before it is taken off. The deactivation means that the power in the alarm security device 2 is turned off and thereby no automatic positioning is possible neither is the alarm security device 2 sending any alarm signals.

If the clasp 4 is opened without first using the deactivation code 66, the alarm security device 2 will still be active in detached mode 64 and the alarm security device 2 will also send an alarm signal to a central station (detached alarm mode 74, Cf FIG. 8 further explained below). When entering this detached alarm mode configuration 74 a "bracelet broken signal" is sent from the device to the base station over the GSM network relying on for example either SMS messaging or the GPRS protocol to the central station. The alarm security device 2 will also register movements and position of the bracelet automatically if the bracelet is brought into the detached alarm mode 74.

Alarm Security Device in Normal Mode

Sensor System

Figure 3A:
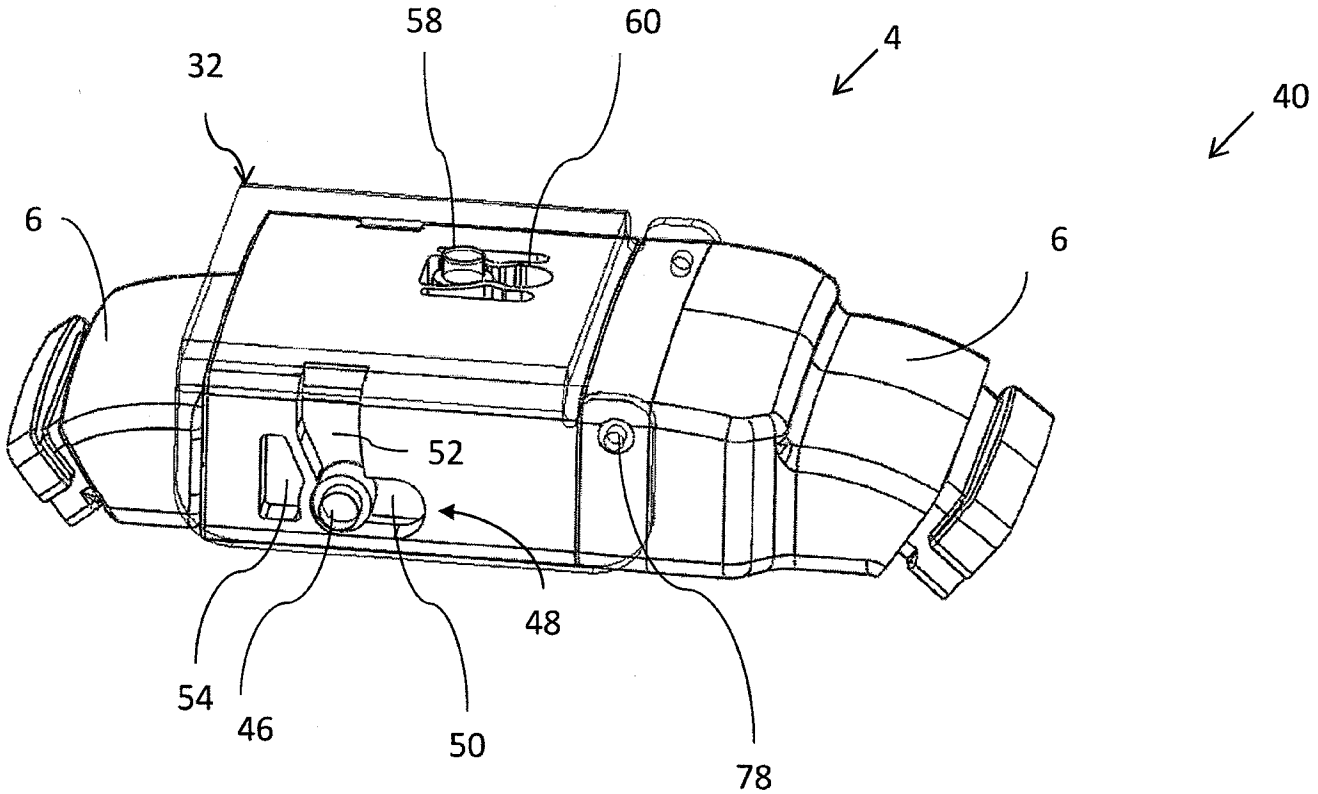
FIG. 3*a* shows an exemplifying embodiment of a clasp of the alarm security device in normal mode according to the present invention.

FIG. 3*a* shows an exemplifying embodiment of the clasp 4 of the alarm security device 2 in normal mode 40.

Figure 3B:
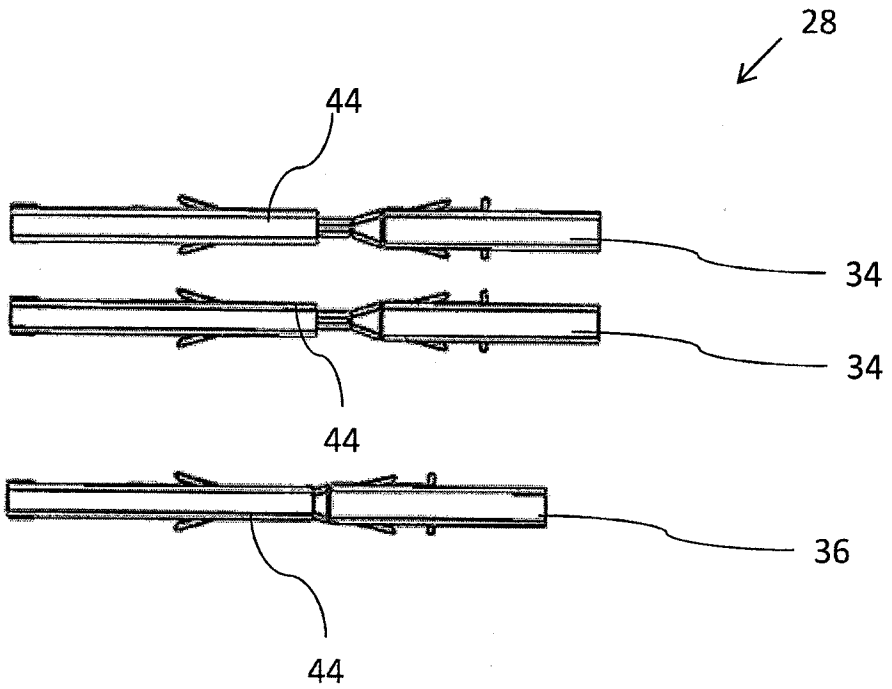

FIG. 3*b* shows a schematic view of the relative position of the contact pins 28 to the corresponding contact sockets 44 in the electronic contact 20 in normal mode 40. The electronic contact comprises long contact pins 36 and short contact pins 34. When the electronic contact 20 of the clasp 4 is in normal mode configuration 40, all the electronic contact pins 28, both the short contact pins 34 and the long contact pins 36 of the male part 24 are in connection with the contact sockets 44 of the female part 22.

As can be seen from FIG. 3*b*, the short contact pins 34 does not physically have to be shorter than the long contact pins 36 but the long contact pins 36 need to be arranged closer to the 30 contact sockets 44 than the short contact pins 34.

Clasp Details

FIG. 3*a* shows an exemplifying embodiment of the mechanical details of the clasp 4 in normal mode 40. When locking the alarm security device 2 the first protrusion 46 of the lid 32 is slid down the transversal leg 52 of the L-shaped recess 48 of the lock mechanism comprising structure 84. Thus in normal mode 4*o*, the first protrusion 46 (which is a part of the lid 32) is located inside the L-shaped 48 recess of the lock mechanism comprising structure 84, in the angle or corner between the transversal leg 52 and the longitudinal leg 50.

The L-shaped recess 48 optionally has a fastening narrowing 76. Also, in one alternative embodiment of the invention, the clasp 4 comprises an additional assisting recess 54, located next to the transversal leg 52 of the L-shaped recess 48 which is enables the first protrusion 46 to slide along the transversal leg 52 of the L-shaped recess 48 with a little resistance, through the optional fastening narrowing 76 inside the transversal leg 52, wherein the assisting recess 54 makes the wall of the transversal leg more flexible. This resistance, which is given when the first protrusion 46 passes fastening narrowing 76 ensures the lid 32 to remain closed when the clasp 4 is in normal mode 40.

In alternative embodiments of the invention the lid 32 may contain the L-shaped recess 48 while the female 22 or a male part 24 of the clasp contains the protrusion.

These different embodiments of the invention have in common that a first protrusion 46 fits inside a matching L-shaped recess 48 and that the first protrusion is located in the corner between the transversal leg 52 and the longitudinal led of the L-shaped recess 48 when the clasp 4 is in normal mode 40.

Figure 4A:
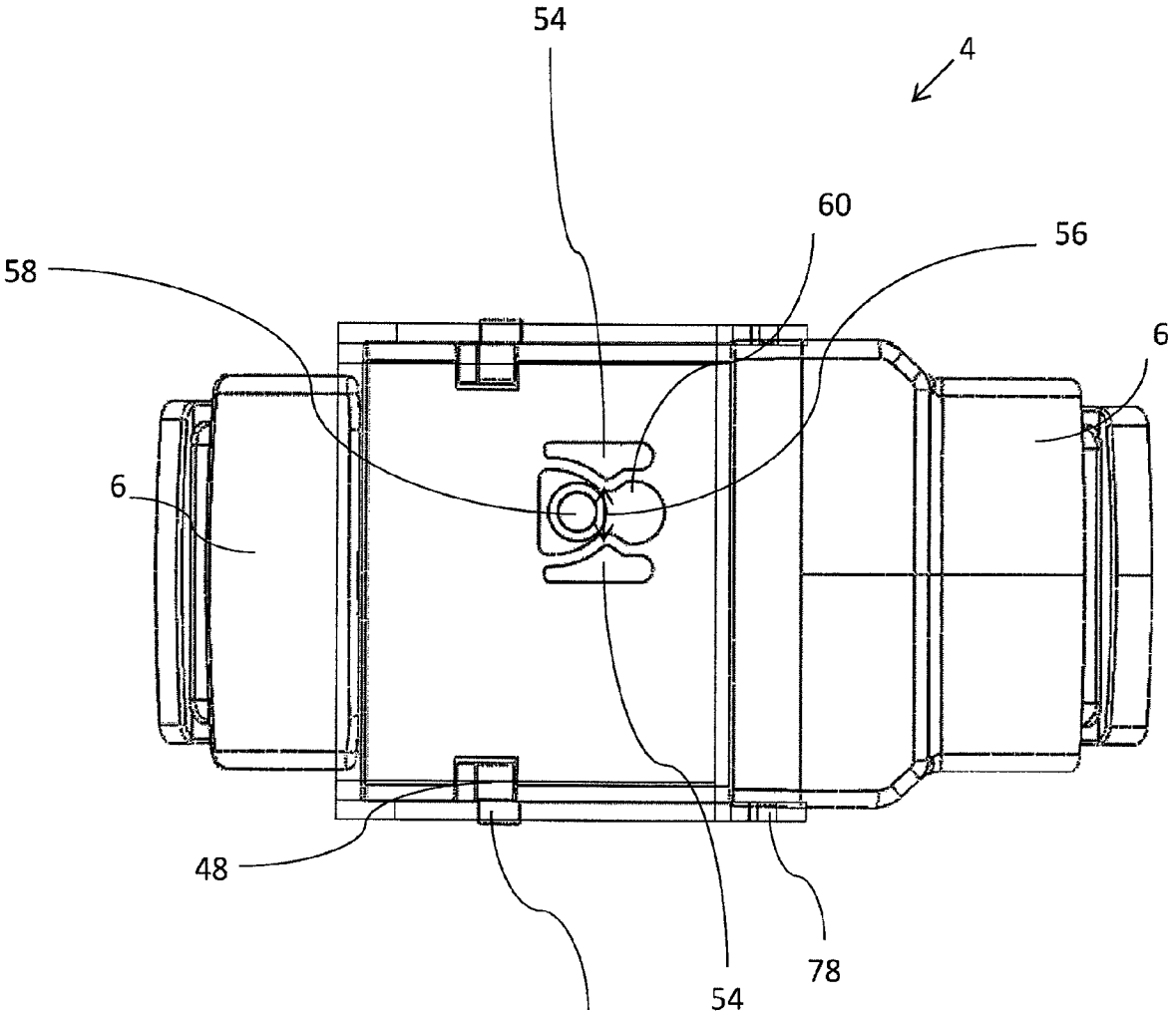
Figure 4B:
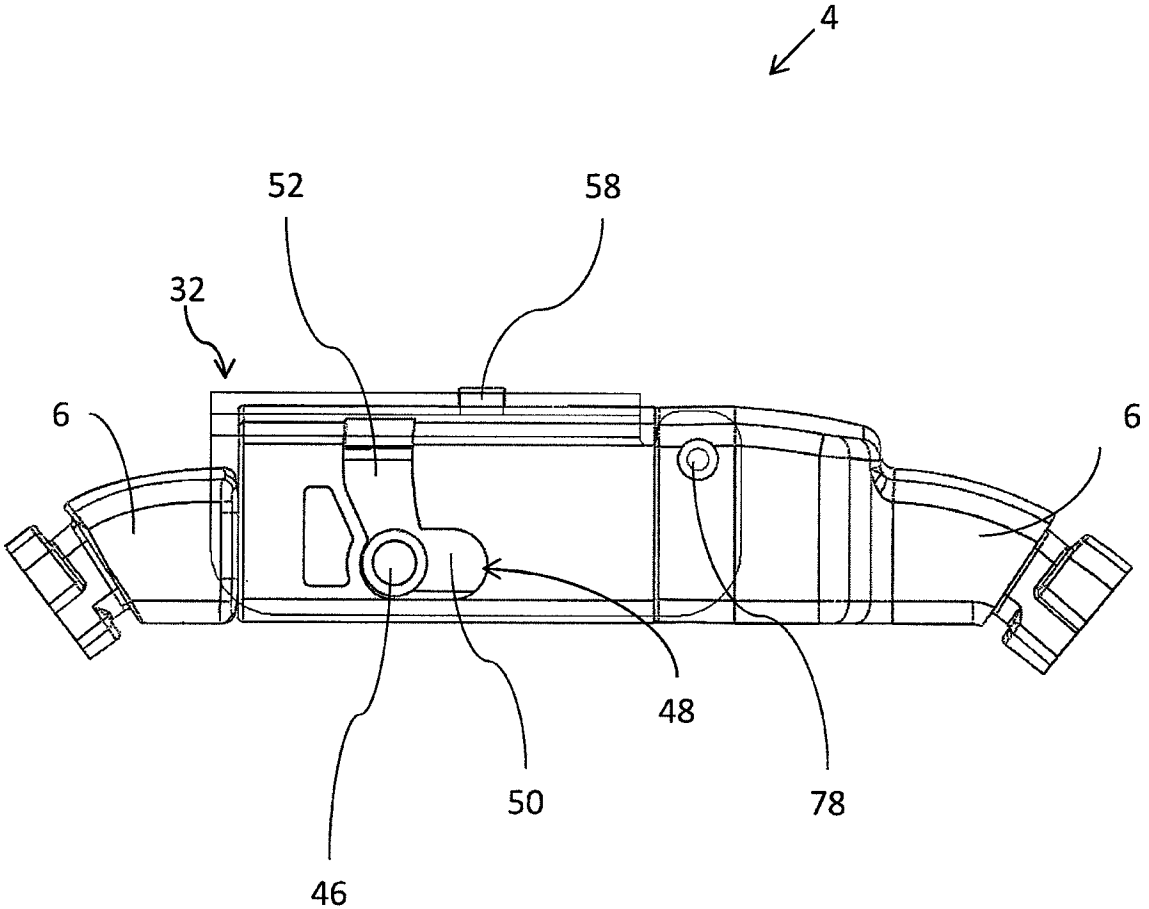

FIG. 4*a-b* shows an exemplifying embodiment of the clasp 4 of the alarm security device 2 in normal mode 40 from a top-view and side view.

In one embodiment of the invention, the clasp contains a second recess 60 which contains an activation narrowing 56. When the clasp comprises a second recess 60 the lid comprises a second protrusion 58 configured to fit inside the second recess 60. In the shown example the second recess 60 is positioned on top of the lock mechanism comprising structure 84. The optional second recess 60 can be formed as an angle shape 88 (see for example FIG. 4*a* for a top-view) but can be formed in other ways comprising a recess and a narrowing.

The angle shape 88 according to the exemplified embodiment of the invention in FIG. 4*a-b* contains two additional assisting recesses 54 which gives the walls of the angle shaped recess body extra flexibility. The angle shape enables the second protrusion 58 situated in the top part of the lid 32, to be moved from the body of the angle (when the alarm security device is in normal mode 40) to the head of the angle (when the alarm security device is in elongated mode 42, see FIG. 5*a*) by using a certain force. The force is determined by the shape and location of the narrowing 56, the size and shape of the protrusion intended to be moved inside the recesses and by the choice of clasp material used.

FIGS. 4*a* and 4*b* also shows how the first protrusion 46 is fitted inside the L-shaped recess 48 in normal mode 40.

Functions

The clasp 4 is closed in normal mode 40, see FIG. 3*a*. The clasp 4 is converted from detached mode 26 to normal mode 40 by attaching the female part 22 of the contact to the male part 24 and then closing a lid 32, by sliding the protrusion 46 within the transversal leg 52 of the L-shaped recess 48.

No alarm signal is sent in normal mode 40 or when entering normal mode 40 but the alarm security device is power supplied and the alarm security device automatically checks its position using GPRS or Wi-Fi modules.

Alarm Security Device in Elongated Mode

Sensor System

FIG. 5*a-b* shows an exemplifying embodiment of the clasp 4 of the alarm security device 2 comprising the electronic contact 20 in elongated mode 42.

When the clasp enters elongated mode 42 an alarm signal is sent to a central server 90 (Cf. FIG. 7 further explained below). The alarm is actuated through a sensor system which senses a change inside the clasp 4. The sensor system is a part of the electronic contact 20 and it comprises the contact pins 28 located in the male part 24 of the electronic contact 20 and the contact sockets 44 located in the female part 22 of the contact 20 (see FIG. 5*b*). A signal is sent when at least one of at least two electronic contact pins 28 inside the clasp 4 looses contact to its corresponding contact socket 44 when the clasp 4 is elongated due to applied traction force or due to opening of the clasp 4. This is achieved by arranging at least two contact pins 28 in the male part 24 of the clasp 4 to have different lengths, or by arranging at least two contact pins 28 to protrude towards the contact sockets 44 with different distances to the sockets 44.

In elongated mode 42, at least one of the short electronic contact pins 34 lacks connection to the corresponding contact socket 44 of the clasp 4, see FIG. 5*b* (the short contact pins 34 of the male part 24 lack connection with the contact sockets 44 of the female part 22 while the long contact pins 36 of the male part 24 are connected to the contact sockets 44 of the female part 22). As can be seen from FIG. 5*b*, the short (or less protruding) contact pins 34 does not physically have to be shorter than the long (or more protruding) contact pins 36 but the long contact pins 36 has to be located or fastened in such a way on the male part 24 of the clasp 4 that that they remain in contact with the corresponding contact sockets 44 in elongated mode 42.

Clasp Details

When a wearer of the alarm security device 2 feels threatened or wants to send an alarm he or she pulls the alarm security device 2, e.g. the bracelet by for example using two fingers inserted between the clasp or chain and the wrist of the user and then pulling outwards. The pulling force or traction force makes the first protrusion 46 move into the longitudinal leg 50 of the L-shaped recess 48 from the transversal leg 52 of the recess (or from the corner between the transversal leg 52 and the longitudinal leg 50), thereby entering elongated mode 42. In the exemplifying embodiment of the invention in FIG. 5*a* there are two L-shaped recesses 48 on the clasp 4, one on each side. In other embodiments of the invention the clasp 4 may only comprise one L-shaped recess 48 or the clasp may comprise more than two L-shaped recesses.

The first protrusions 46 positioned inside the longitudinal legs 50 prevent opening of the lid 32 when the clasp is in elongated mode 42. The clasp 4 can only be opened again if the parts of the clasp are pushed back into the short, normal mode 40 again (and thus shifting the position of the first protrusion 46 back in the transversal leg 52 of the L-shaped recess 48).

The clasp 4 is conformed to give a certain resistance when changed from normal mode 40 to elongated mode 42 by pull forces. The resistance may be achieved due to an activation narrowing 56 in one of the recesses 46, 60 through which one of the protrusions 46, 58 must be moved.

In FIG. 5*a-b* the resistance is due to an activation narrowing 56 inside the second recess 60. The second protrusion 58 passes the activation narrowing 56 simultaneously as the first protrusion 46 moves inside the longitudinal leg 5*o* if the L-shaped recess 48. See FIG. 4*a* for clasp in normal mode 40 and FIG. 5*a* for clasp in elongated mode 42.

In one embodiment the longitudinal leg 50 of the L-shaped recess 48 comprises the activation narrowing 56 (see FIG. 6*a-*6*b* for alternative exemplifying embodiments wherein the activation narrowing 56 is located inside the L-shaped recess). The activation narrowing 56 inside the longitudinal leg 50 of the L-shaped recess 48) is slightly narrower than the first protrusion 46, giving a certain resistance when moving the first protrusion 46 inside the longitudinal leg 50 of the L-shaped recess 48 entering the elongated mode 42.

Functions

When entering this elongated mode 42, the loss of contact between a short contact pin 34 and its corresponding contact socket 44 causes a "force alarm signal" from the device to the base station over the GSM network relying on for example either SMS messaging or the GPRS protocol to a central server. The frequency of automatic determination of the position of the alarm security alarm 2 increases in elongated mode 42 compared to when the clasp 4 is in the normal mode 40.

Alternative Embodiments of the Electronic Details of the Electronic Contact of the Alarm Security Device Different numbers of contact pins 28 and contact sockets 44 can be used within the electronic contact 20. Since the contact pins 28 are sensors for determining which type of signal to be sent, additional alternative signals could be sent using more contact pins 28 giving different signal codes which could be sent to the central server 90 (Cf. FIG. 7 further explained below).

In other alternative embodiments of the invention the contact sockets 44 are in varying length and the contact pins 28 are in the same length, giving the same effect, i.e. that the "short" socket and it corresponding pin looses contact when the contact is pulled and changed from normal mode 40 to elongated mode 42.

Alternative Embodiments of the Mechanical Details of the Alarm Security Device

FIG. 6*a*-6*b* shows alternative embodiments of different clasp configurations according to 20 the invention.

FIG. 6*a* shows an alternative embodiment of the invention wherein the clasp comprises a modified L-shaped recess 48 with the narrowing 56 placed in the middle of the longitudinal leg 50 of the recess. In this exemplifying embodiment of the invention the movement of the first protrusion inside the longitudinal leg may start without any additional force and then activation force is needed when the protrusion has already moved a bit inside the longitudinal leg. The alternative embodiment in example 6*a* lacks an optional second recess.

FIG. 6*b* shows an alternative embodiment of the invention wherein the clasp 4 comprises a modified L-shaped recess 48 with the narrowing 56 placed in the beginning of the longitudinal leg 50 of the recess, close to the transversal leg 50. According to this alternative embodiment of the invention in FIG. 6*b*, the clap does not contain a second recess 60. But in other embodiments of the invention the clasp comprises both a first 48 and a second recess 6*o* or several first or second recesses and their corresponding protrusions.

In the exemplifying embodiment in FIG. 6*b*, the movement of the protrusion inside the longitudinal leg 50 cannot start without forcing the first protrusion 46 to pass the narrowing 56 inside the longitudinal leg first.

In other alternative embodiments of the invention wherein the clasp comprises, additional to the L-shaped recess 48 and the first protrusion 46, a second protrusion 58. And wherein the second protrusion 46 is intended to fit inside a second recess 60 and wherein the second recess 60 comprises an narrowing 56 slightly smaller than the second protrusion 58 and the L-shaped recess 48 does not contain a narrowing. The second protrusion 58 can be of different conformations all containing a narrowing 56 slightly narrower than the second protrusion 58 (see FIG. 8*a* for an example).

In other alternative embodiments of the invention the placement of the second recess 60 can be anywhere on the top surface 62 of the lid 32 or the lock mechanism comprising structure 84 but the movement of the second protrusion 58 inside the recess 60 must be in the same direction as the movement of the first protrusion 46 inside the longitudinal leg 50 of the L-shaped recess 48, i.e a movement permitting elongation of the alarm security device 2.

In other alternative embodiments of the invention the clasp comprises several second recesses with narrowings and/or several L-shaped recesses with or without narrowing.

Material Choices

The protrusions and the recesses are made of materials suitable to give the desired resistance, created from forces between the narrowing 56 in a recess and the protrusion when pulling the bracelet. The resistance and thus the force needed have to be repeatable and reliable because it is through to the resistance the transformation of the clasp from normal mode to elongated mode is achieved. This transformation also activates the alarm signal. The activation cannot be actuated too easily, causing the alarm to be activated by accident. On the other hand, the activation should not have to involve too much force either. Then there is a risk that the alarm will not be activated if the bearer is under a lot of stress and is not able to manage strong forces. Suitable materials for the protrusion are for example different types of plastic material or rubber or plastics with rubber cover. Suitable materials for the surfaces surrounding the recess are also rubber or plastic materials which are able to give the desired resistance of the protrusion in the recess. The activation narrowing 56 is slightly smaller than the corresponding protrusion and preferably the resistance is adapted depending on if the bearer is for example a child, teenager or an elderly person. Different material choices will give the different activation forces. The measures of the size of the protrusion and the recesses depend on which type of material that is chosen for making those parts of the clasp.

The contact pins 28 and the connectors/contact sockets 44 are made in materials suitable for electronic contacts such as conducting materials for example different metals, for example copper.

Electronic Functions of the Alarm Security Device

The electronic functions, as already mentioned are coupled to the mechanic details and also to the electronic details of the clasp 4 of the alarm security device 2. The electronic functions are located inside the chain of the alarm security device 2 and also inside the clasp 4.

FIG. 7 shows a brief description of an example of how the signaling system of the clasp may work. The clasp is activated by a pull force applied to the chain 6 or the clasp 4. The bearer or the person wearing the clasp 100, separates the clasp 4 into an elongated mode 42 by using a pull force. Due to the elongation of the clasp 4, the short electronic contact pins 34 are separated from their corresponding sockets 44 and an alarm signal is sent. This alarm signal is for example sent by over the GSM network relying on either SMS or GPRS techniques inside the chain of the alarm security device 2 via an antenna 92 to a central server 90.

Positioning of the bracelet may automatically be checked (automatic positioning) when the bracelet is in the detached 26, normal 40 and elongated mode 42. When the alarm security device 2 is supplied with power, it communicates its position to a central server 90 in certain time intervals (called automatic usage or heartbeat). The GPS/GPRS modules inside the clasp automatically contacts satellites 94 for retrieval of positioning information. Alternatively the Wi-Fi module contacts local servers for positional information. The positioning information is sent via GSM module to the central server 90. The automatic positioning checking can be turned off in the detached mode 26 if a deactivation code 66 is entered before opening the clasp 4 (entering detached mode 26). The frequency of the positioning information retrieval changes in the different clasp modes. The alarm signal is then further sent on to for example an call center or alarm center or security center 96 and/or to friends and family 98 of the bearer 100.

Some additional electronic functions of the clasp 4 are described below but the electronic functions of the alarm security device 2 are not limited to the following functions;

FIG. 8 shows a schematic view over the different modes of the clasp. The alarm security device 2 is normally worn by a bearer in normal mode 4*o*, wherein both the long 36 and the short 34 contact pins are connected to their corresponding contact sockets 44 and the position of the alarm device 2 is sent to the central server 90 with regular intervals. If the alarm security device 2 is removed from the bearer without using a deactivation code 66 the clasp is transformed to detached alarm mode 74 and an alarm signal is sent to a central server 90.

On the other hand, if the alarm security device 2 is decoded by using a deactivation code 66 and is removed from the bearer afterwards it becomes inactive and the clasp then enters the detached non-powered mode 74 and thereby stops automatically to communicate its position. It is an important function that the device 2 can be turned off when circumstances require it, e.g. on a store shelf/warehouse, on an airplane, at bedtime etc. In both detached alarm mode 74 and detached non-powered mode 64 the clasp is configured in detached mode 26.

From normal mode 40 the alarm device may also enter elongated mode 42, as the alarm security device 2 is being pulled with a sufficient traction force. The short contact pins 34 are then separated from their contact sockets 44, while the long contact pins 36 remain in contact with their contacts sockets 44, and the alarm is set off.

The alarm signal due to unauthorized opening of the alarm security device 2 (without using deactivation code 66) is called "Bracelet open alarm" and is different from the alarm signal sent when the clasp 4 is elongated which is called "force alarm". The different signals are due to the contact pins 28 of different length. When the bracelet is in the detached alarm mode 74, none of the contact pins have contact with each other and in the elongated mode 42 the short contact pins 34 looses contact while the long contact pins 36 stay connected. These signals are sent to the server and the central server 90 can detect which type of alarm that is sent depending on which signals it receives.

The alarm signal is sent when the alarm security device 2 is activated either by elongation or detachment. The alarm signal is turned off either by using a deactivation code 66 or by contacting the central server and the central server sends information to the clasp to turn off the alarm function. The alarm security device can after having been forced to elongated mode be pushed back into normal mode. However to turn off the alarm signal the deactivation code 66 or another contact with the server is needed. Other contact with server can for example be by calling or otherwise contacting the manufacturers responsible for the central sever and the support for the alarm security device, then the alarm is turned off manually.

Geographic Position and Frequency

The frequency of automatic positioning determination usage when the clasp 4 is in the normal mode 40 of the GPS and GSM modules of the clasp 4 is changing depending on the geographic position of the bracelet, see FIG. 9.

The frequency is minimal if the bracelet is within a predefined safe zone (aka geo-fence) 68

The frequency increases if the bracelet leaves the predefined safe zone (aka geo-fence) to a neutral zone 72

The frequency increases even further if the bracelet enters a pre-defined unsafe zone (aka no-go zone) 70

In elongated mode 54 the frequency for automatic positioning determination usage is at maximum.

The invention claimed is:

1. An alarm security device comprising an activation clasp which comprises an electronic contact wherein said clasp comprises a male part and a receiving female part; and that the male part comprises at least one long contact pin and at least one short contact pin and the female part comprises receiving contact sockets for each of the contact pins and wherein the electronic contact is settable between three different modes;

a detached mode where none of the contact pins of the male part are in connection with the contact sockets of the female part of the clasp and thus the electronic contact and the clasp is open; and a normal mode wherein all the contact pins of the male part are in connection with the contact sockets of the female part and the clasp is closed; and an elongated mode wherein the short contact pin of the male part lacks connection with the contact socket of the female part while the long contact pin of the female part is/are connected to the contact socket of the male part and when entering the elongated mode an alarm signal is sent.

2. An alarm security device according to claim 1, wherein the alarm security device is in the form of a bracelet, wristband or necklace, configured to be worn around a body part of a user.

3. An alarm security device according to claim 1, arranged to be transformed between said modes of the clasp into elongated mode is performed by a pull mechanism whereby a traction force separates the male and the female part of the clasp.

4. An alarm security device according to claim 1, wherein said alarm signal is a digital signal.

5. An alarm security device according to claim 1, wherein said alarm signal is a audio signal.

6. An alarm security device according to claim 1, wherein when entering the elongated mode an alarm signal is sent to a central server.

7. An alarm security device according to claim 1, wherein when entering the normal mode from the detached mode the electronics in the alarm security device is activated.

8. An alarm security device according to claim 1, wherein when entering the normal mode from the elongated mode by using a deactivation code, the alarm signal in the alarm security device is not triggered.

9. An alarm security device according to claim 1, wherein when entering the detached mode from the normal mode without entering a deactivation code, an alarm signal is triggered.

10. An alarm security device according to claim 1, wherein the alarm security device comprises chargeable batteries and wherein one side of the electronic contact is configured to receive a battery charger.

11. An alarm security device according to claim 1, wherein the three different modes is supported by a mechanic clasp mechanism.

12. An alarm security device according to claim 1, wherein the alarm security device comprises GPS or GPRS or Wi-Fi modules and is active by automatically determining the position of the alarm security device by GPS or GPRS or Wi-Fi at a predetermined frequency in normal mode and wherein the frequency is further increasing when entering elongated mode.

13. An alarm security device according to claim 1, wherein the alarm signal type sent to the central server is dependent on whether if the signal is triggered entering elongated mode or detached mode or not.

* * * * *